US011585305B2

(12) United States Patent
Guzman Trevino et al.

(10) Patent No.: US 11,585,305 B2
(45) Date of Patent: Feb. 21, 2023

(54) MONOLITHIC FUEL RAIL STRUCTURE AND METHOD OF MANUFACTURE

(71) Applicant: Robert Bosch GmbH, Stuttgart (DE)

(72) Inventors: Luis Humberto Guzman Trevino, Tampico (MX); Cesar Omar Medina Juarez, San Luis Potosi (MX); John Casari, Manchester, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/548,041

(22) Filed: Dec. 10, 2021

(65) Prior Publication Data

US 2022/0186696 A1 Jun. 16, 2022

Related U.S. Application Data

(60) Provisional application No. 63/125,536, filed on Dec. 15, 2020.

(51) Int. Cl.

| | |
|---|---|
| ***F02M 55/00*** | (2006.01) |
| ***F02M 55/02*** | (2006.01) |
| ***F02M 61/04*** | (2006.01) |

(52) U.S. Cl.

CPC ..... *F02M 55/025* (2013.01); *F02M 55/005* (2013.01); *F02M 61/04* (2013.01)

(58) Field of Classification Search

CPC .... F02M 61/168; F02M 61/04; F02M 55/004; F02M 55/005; F02M 55/025

USPC ..... 123/470, 456

See application file for complete search history.

(56) References Cited

U.S. PATENT DOCUMENTS

| | | | | |
|---|---|---|---|---|
| 4,449,595 | A | 5/1984 | Holbert | |
| 4,769,118 | A | 9/1988 | Johns | |
| 5,029,759 | A | 7/1991 | Weber | |
| 5,213,168 | A | 5/1993 | Warren et al. | |
| 6,362,446 | B1 | 3/2002 | Jones et al. | |
| 7,159,569 | B2 | 1/2007 | Keegan et al. | |
| 7,469,680 | B2 | 12/2008 | Merchant et al. | |
| 8,338,745 | B2 | 12/2012 | Liu | |
| 9,810,189 | B2 | 11/2017 | Maier et al. | |
| 10,436,163 | B2 | 10/2019 | Serra et al. | |
| 10,473,075 | B2 | 11/2019 | Kubota et al. | |
| 10,582,935 | B2 | 3/2020 | Burley et al. | |
| 2011/0108005 | A1 | 5/2011 | Nishizawa et al. | |
| 2013/0312705 | A1 | 11/2013 | Isogai et al. | |
| 2020/0332750 | A1 * | 10/2020 | Boone | F02M 63/0275 |

(Continued)

FOREIGN PATENT DOCUMENTS

| | | | | |
|---|---|---|---|---|
| EP | 3670895 | * | 3/2021 | F02M 61/14 |

*Primary Examiner* — Hai H Huynh

(74) *Attorney, Agent, or Firm* — Kelly McGlashen; Maginot, Moore & Beck LLP

(57) ABSTRACT

A monolithic fuel rail structure is configured to receive and support a fuel injector, and includes a log, an injector cup that protrudes integrally from an outer surface of the log, and a fuel passage. An inner surface of the log defines a main fuel channel, and the injector cup includes a bore that opens at one end of the injector cup. An inlet end of the fuel injector is received in the bore. The fuel passage provides fluid communication between the bore and the main fuel channel, and the fuel passage corresponds to a portion of a hole that extends through the injector cup on each of opposed sides of the injector cup.

13 Claims, 6 Drawing Sheets

(56) References Cited

U.S. PATENT DOCUMENTS

| | | | | |
|---|---|---|---|---|
| 2021/0079877 | A1* | 3/2021 | Masti | F02M 61/168 |
| 2022/0184724 | A1* | 6/2022 | Guzman Trevino | B23H 7/26 |

* cited by examiner

MONOLITHIC FUEL RAIL STRUCTURE AND METHOD OF MANUFACTURE

BACKGROUND

A fuel rail may be used to supply fuel to multiple fuel injectors that inject fuel into the intake manifold of an internal combustion engine. The inlet ends of the fuel injectors are often removably secured to the fuel rail using clips or other similar mechanical attachment means, and outlet ends of the fuel injectors may engage corresponding openings or ports in the intake manifold. In some applications, the fuel rail may supply high-pressure fuel through the fuel injectors by directly injecting into corresponding engine cylinders.

Although plastic fuel rails are known, metal fuel rails may be used to deliver fuel at high pressure, and include a main fluid supply pipe referred to as a "log". As used herein, the term "high pressure" refers to pressures greater than 250 bar. The log has a main fuel channel through which fuel is supplied from a fuel tank or fuel pump. The fuel rail includes distribution arms for distributing fuel to the individual cylinders of the engine. The distribution anus protrude from the log and provide fuel passages that communicate with the main fuel channel. The distribution arms each terminate in an injector cup (sometimes referred to as a bushing). Each injector cup includes a bore that receives and retains the inlet end of a fuel injector. The fuel injector inlet end includes a seal that fills the space between the fuel injector and the bore to define a high pressure fuel distribution chamber within the injector cup. Fuel is provided at high pressure to the fuel distribution chamber via the main fuel channel of the log and the fuel passageways of the respective distribution arm. The relative geometry of the log, distribution arms and injector cups is complex, and is dependent on engine geometry and available space within the engine system.

SUMMARY

A monolithic fuel rail structure that is configured to provide high-pressure distribution of fuel is made using a manufacturing process in which the log, the distribution arms, and the injector cups, are formed integrally from a single billet of metal. The manufacturing process used to form the monolithic fuel rail structure may include, but is not limited to, extrusion, casting, forging and injection molding. These methods require conventional machining (for example, drilling) to provide the main fuel channel within the log, the fuel passage within each distribution arm, and the bore within each injector cup. However, it is challenging to machine the distribution arm fuel passage through the injector cup bore into the log main fuel channel without contacting the bore and disturbing the integrity of the fuel distribution chamber, particularly in geometries in which a centerline of the bore is offset relative to a centerline of the main fuel channel. For example, in order to avoid disturbing the integrity of the fuel distribution chamber, machining is limited to providing a fuel passage that is aligned with a centerline of the bore and having a maximum offset from the centerline of the bore corresponding to a radius of the bore. Thus, the range of fuel distribution paths and the ability of the fuel rail structure to fit into the available space within the engine system is limited.

To achieve greater design flexibility, the inventors recognized that it would acceptable to form openings in the injector cup at locations outside the high pressure fuel distribution chamber that is provided at the fuel injector inlet end. In particular, it was recognized that forming an opening in the injector cup at locations between the fuel injector seal and the injector cup open end would not compromise the integrity of the fuel distribution chamber. In particular, the fuel passage opening enters the injector cup at a location that is below the seal, passes through the bore and exits the injector cup at a location that is above the seal. The fuel passage opening extends into the log main fuel channel via the distribution arm. By doing so, the fuel passage between the bore and the main fuel channel can be formed at greater offsets and at non-zero angles relative to the centerline of the bore. Thus, the fuel passage that connects the main fuel channel of the log to the bore of the integral injector cup is formed through the injector cup via an entry formed in a sidewall of the injector cup and extending at an angle to the centerline of the bore, allowing for an offset from the center line of the log in two orthogonal directions that are perpendicular to a centerline of the main fuel channel. By machining in this manner, the engine designers have increased flexibility to package the fuel rail assembly to the engine. Moreover, the fuel rail disclosed herein is "backward compatible." That is, a given engine can be upgraded increasing fuel pressure and reducing the number of parts, with limited redesign and testing of the cylinder head, fuel injectors, pressure sensors, conning tubes and electrical harnesses, etc., saving the builder time and money while reducing risk of untested components. In addition, the fuel rail disclosed herein allows re-use of equipment and process measures.

The monolithic fuel rail structure disclosed herein is an improvement with respect to some conventional fuel distribution systems in which the log, the distribution arms and the injector cups are an amalgamation of separate, individual components such as tubes, injector bushings, plugs, sensor attachments, fuel inlets and outlets, etcetera. These individual components may be affixed together with various types of mechanical clamping, welding, and brazing. However, these attachment methods are often associated with contamination and weakness of mating retention. The contamination may cause blockage of the connecting passage and any inadequate retention or mating can insufficiently fill the space, whereby the fuel may not be distributed in the quantity and location and for the life as intended.

In some embodiments, the fuel passage is machined using an electrical discharge machining (EDM) process. This process is ideally suited for forming the fuel passage since EDM is a precise process and the material removed by EDM is dissolved, whereby the resulting hole is clean and can be deburred via electro-polishing of the completed fuel rail device. Importantly, the EDM process leaves no chips, debris or other contaminants in the machined part, which can negatively affect function and durability. Although other machining methods can be employed to form the fuel passage, such as twist drilling, laser burning, plasma burning, and water jet erosion, the other machining methods may not suitable in some embodiments due to potential for contamination, relative impreciseness and/or relatively poor shaping control.

In some embodiments, the diameter of the fuel passage between the injector cup bore and the log main fuel channel may be in a range of 1 mm to 3.5 mm. The length of the fuel passage combined with the diameter may provide a pressure damping effect that can supplement or replace an orifice commonly found in the rail inlet fitting or injector cup for this purpose. Thus, costs associated with the rail inlet fitting or formation of the orifice may be reduced.

In some aspects, a monolithic fuel rail structure is configured to receive and support a fuel injector. The fuel injector has an injector housing, a fuel inlet end, a fuel outlet end opposed to the fuel inlet end, and a seal disposed on an outer surface of the injector housing. The monolithic fuel rail structure includes a log, an injector cup that protrudes integrally from an outer surface of the log and a fuel passage. The log includes a log first end, a log second end that is opposed to the log first end, and a log inner surface that defines a main fuel channel. The main fuel channel is concentric with a longitudinal axis of the log, and the longitudinal axis of the log extends between the log first end and the log second end. The injector cup includes a sidewall, an inner surface of the sidewall defining a bore. The injector cup includes a proximal end that closes one end of the sidewall, and a distal end that is opposite the proximal end. The distal end is open, and a centerline of the sidewall extends through the proximal end and the distal end. The bore includes an open end that coincides with the distal end. In addition, the bore includes a blind end disposed between open end and the injector cup proximal end. The fuel passage provides fluid communication between the bore and the main fuel channel, the fuel passage corresponding to a portion of a hole that extends through the injector cup on each of opposed sides of the injector cup.

In some embodiments, the hole passes through the injector cup sidewall so as to extend through a log facing side of the sidewall and extend through a side of the sidewall that is opposed to the log-facing side of the sidewall.

In some embodiments, the sidewall inner surface includes a seal seating region that receives the seal when a fuel injector is disposed in the injector cup. The seal seating region is disposed between the open end and the blind end. The hole is coincident with a straight line that passes through the sidewall. The straight line includes a) a first line portion that resides in a first portion of the injector cup, the first portion of the injector cup being disposed between the seal seating region and the proximal end, and b) a second line portion that resides in a second portion of the injector cup, the second portion of the injector cup being disposed between the seal seating region and the distal end.

In some embodiments, the seal seating region has a dimension in a direction parallel to the centerline of the sidewall that is greater than a dimension of the seal in a direction parallel to the centerline of the sidewall so as to accommodate movement of the fuel injector within the injector cup during operation of the fuel rail structure.

In some embodiments, the hole extends through a first portion of the sidewall, and the first portion of injector cup includes the first portion of the sidewall.

In some embodiments, the hole extends through a second portion of the sidewall, and the second portion of injector cup includes the second portion of the sidewall.

In some embodiments, the first line portion intersects the sidewall at a location between the seal seating region and the blind end, and the second line portion intersects the sidewall at a location between the seal seating region and the open end.

In some embodiments, the hole is coincident with a straight line that passes through the sidewall, the straight line is at an angle θ relative to a Y axis. The Y axis intersects, and is perpendicular to, the longitudinal axis of the log. In addition, the Y axis is parallel to the centerline of the sidewall, and the angle θ is in a range of 0 degrees to forty five degrees.

In some embodiments, the injector cup is connected to the outer surface of the log via a distribution arm having an arm first end that is integral with the outer surface of the log and an arm second end that is integral with the injector cup, and the fuel passage passes through the distribution arm.

In some embodiments, the distribution arm has sufficient length that the injector cup is spaced apart from the log.

In some embodiments, the seal seating region has a dimension in a direction parallel to the centerline of the sidewall that is in a range of 150 percent to 300 percent greater than a corresponding dimension of the seal.

In some aspects, a fuel rail assembly includes a monolithic fuel rail structure and a fuel injector that is supported on the fuel rail structure. The fuel injector includes an injector housing, a fuel inlet end, a fuel outlet end opposed to the fuel inlet end, and a seal disposed on an outer surface of the injector housing. The monolithic fuel rail structure includes a log, an injector cup that protrudes integrally from an outer surface of the log, and a fuel passage. The log includes a log first end, a log second end that is opposed to the log first end and a log inner surface that defines a main fuel channel. The main fuel channel is concentric with a longitudinal axis of the log. The longitudinal axis of the log extends between the log first end and the log second end. The injector cup includes a sidewall, an inner surface of the sidewall defining a bore. The injector cup includes a proximal end that closes one end of the sidewall and a distal end that is opposite the proximal end. The distal end is open, and a centerline of the sidewall extends through the proximal end and the distal end. The bore includes an open end that coincides with the distal end, and a blind end that is disposed between the open end and the injector cup proximal end. In addition, the fuel passage provides fluid communication between the bore and the main fuel channel, The fuel passage corresponds to a portion of a hole that extends through the injector cup on each of opposed sides of the injector cup.

In some aspects, a method of manufacturing a monolithic fuel rail structure is provided. The method includes the following method steps: Providing a metal billet; Heating the metal billet to a predetermined temperature that is less than the melting temperature of the metal; Forging the heated metal billet to provide a monolithic fuel rail structure. The fuel rail structure includes a log and an injector cup that protrudes integrally from an outer surface of the log. The injector cup includes a cylindrical sidewall, and an inner surface of the sidewall defines a bore. The injector cup includes a proximal end that closes one end of the sidewall, and a distal end that is opposite the proximal end. The distal end is open. The method includes the following additional method steps: Machining a main fuel channel in the log; Machining a bore in the injector cup; and Machining a fuel passage in the fuel rail structure that provides fluid communication between the main fuel passage and the bore. The fuel passage corresponds to a portion of a hole that extends through the injector cup on each of opposed sides of the injector cup.

In some embodiments, the hole passes through the injector cup sidewall so as to extend through a log-facing side of the sidewall and extend through a side of the sidewall that is opposed to the log-facing side of the sidewall.

In some embodiments, the inner surface of the injector cup comprises a seal seating region configured to receive a seal of a fuel injector. The seal seating region is disposed between the proximal end and the distal end, and the step of machining a fuel passage in the fuel rail structure includes forming the hole such that it extends along a straight line. The straight lines includes a) a first line portion that resides in a first portion of the injector cup, the first portion of the injector cup being disposed between the seal seating region and the proximal end, and b) a second line portion that resides in a second portion of the injector cup, the second portion of the injector cup being disposed between the seal seating region and the distal end.

In some embodiments, the step of machining a fuel passage consists of making a single hole in the fuel rail structure, and the single hole is interrupted by the bore and extends through each of opposes sides of the fuel injector cup.

In some embodiments, the step of machining a fuel passage in the fuel rail structure comprises using an electrical discharge machining (EDM) process.

In some embodiments, the EDM process employs a rigid, straight electrode.

In some aspects, a monolithic fuel rail structure is configured to receive and support a fuel injector relative to a cylinder of an engine. The monolithic fuel rail structure includes a log having an inner surface that defines a main fuel channel, and an injector cup that protrudes integrally from an outer surface of the log. An inner surface of the injector cup defines a bore that opens at one end of the injector cup. The monolithic fuel rail structure includes a fuel passage that provides fluid communication between the bore and the main fuel channel. The fuel passage corresponds to a portion of a hole that extends through the injector cup on each of opposed sides of the injector cup.

DETAILED DESCRIPTION

Figure 1:
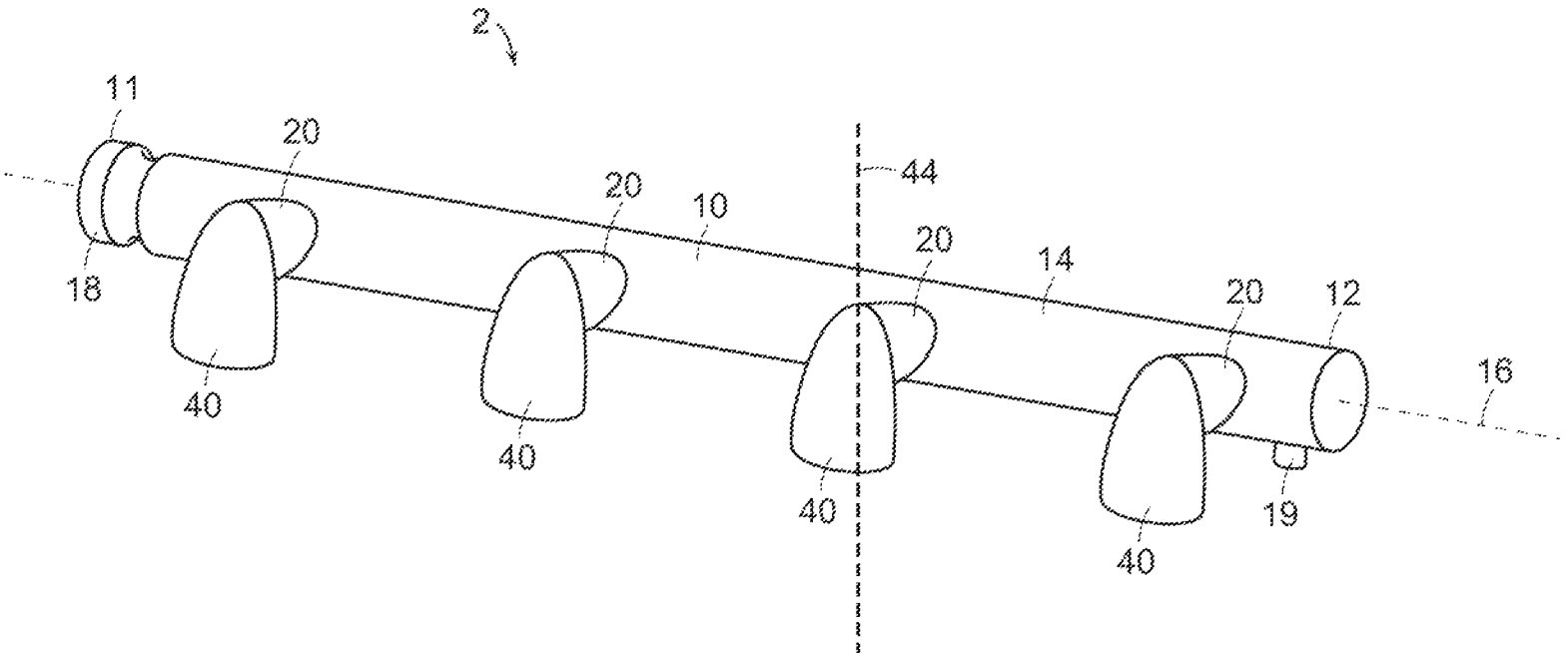
FIG. 1 is a perspective view of a monolithic fuel rail structure.
Figure 2:
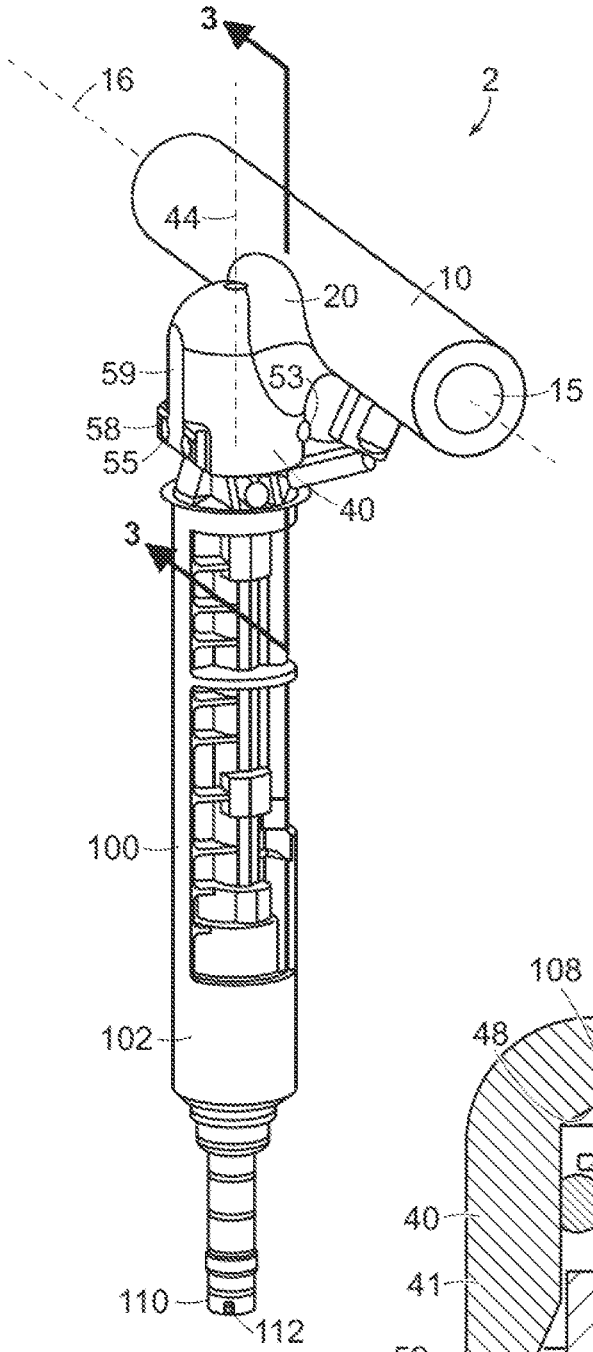
FIG. 2 is a perspective view of a portion of the monolithic fuel rail structure of FIG. 1, shown with a fuel injector disposed in the injector cup.
Figure 3:
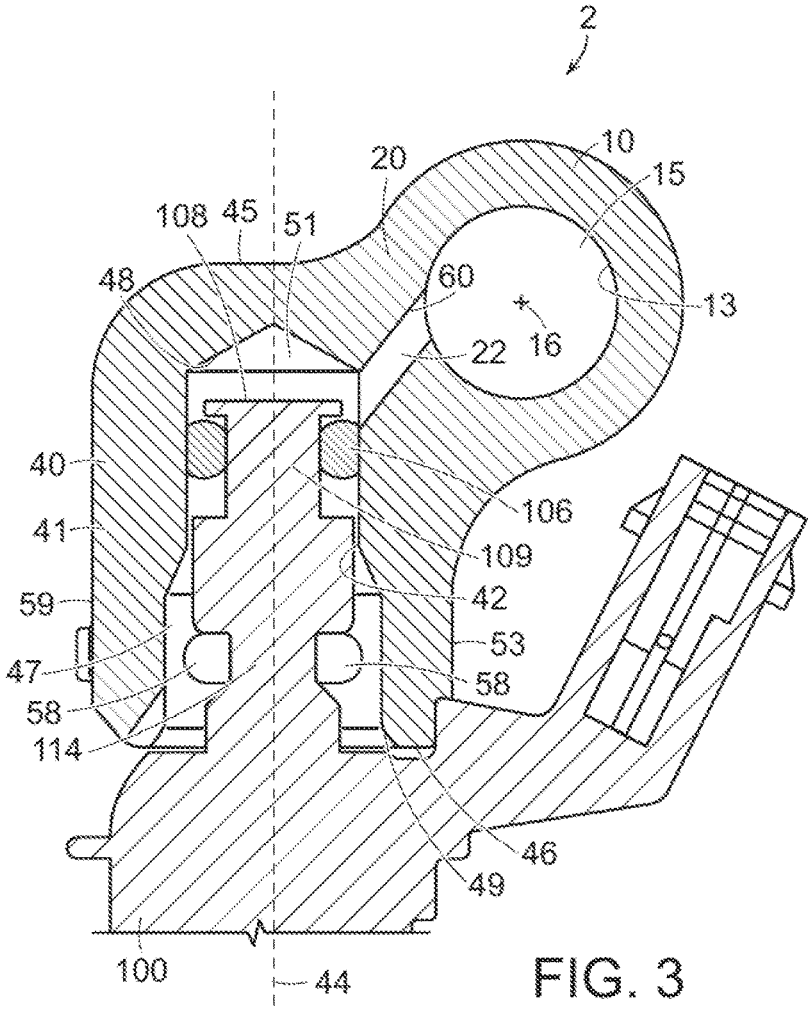
FIGS. 3-5 are each a cross sectional view of a portion of FIG. 2 as seen along line 3-3 of FIG. 2.

Referring to FIGS. 1-3, a monolithic fuel rail structure 2 is configured to supply fuel to multiple fuel injectors 100 that inject fuel directly into the cylinders of an internal combustion engine (not shown). The fuel rail structure 2 includes a log 10 that receives high pressure fuel from a fuel tank or fuel pump (not shown). The fuel rail structure 2 includes integral distribution arms 20 that are spaced apart along the length of the log 10 and protrude from an outer surface 14 of the log 10. As used herein, the term "integral" is defined as "being of the whole, being formed as a single unit with another part." Each distribution arm 20 is configured to distribute pressurized fuel to a respective individual cylinder of the engine. Each distribution arm 20 terminates in an integral injector cup 40, which is configured to receive an inlet end 108 of a fuel injector 100. Each fuel injector 100 includes a circumferential seal 106 adjacent the inlet end 108, and the seal 106 forms a fluid-tight seal with an inner surface of the corresponding injector cup 40. In addition, the fuel injector 100 is detachably secured to the injector cup 40 using pins, clips or other similar mechanical attachment means. Fuel is provided at high pressure to a fuel distribution chamber 51 defined within each injector cup 40 via the main fuel channel 15 of the log 10 and the fuel passageways 22 of the respective distribution arms 20. Thus high pressure fuel received in the fuel rail structure 2 is distributed directly into each cylinder of the engine via a respective distribution arm 20, injector cup 40 and fuel injector 100. The relative geometry of the log 10, distribution anus 20 and injector cups 40 is complex, and is dependent on engine geometry and available space within the engine system. The fuel passage 22 is formed between the main fuel channel 15 of the log 10 and the fuel distribution chamber 51 of the injector cup 40 via an EDM process that includes forming an entry hole in an outer surface 43 of the injector cup 40, as discussed in detail below.

The fuel injector 100 may be a high pressure device used for direct injection into a cylinder of a gasoline engine. The fuel injector 100 may include an elongate, generally tubular valve housing 102 that supports an injector valve (not shown). The valve housing 102 is an elongate, generally tubular structure. The inlet end 108 of the valve housing 102 provides a fuel connection nipple 109 having the circumferentially extending O-ring seal 106. The outlet end 110 of the valve housing 102 is opposed to the inlet end 108, and provides a valve seat (not shown) and fuel spray opening or nozzle 112. The seal 106 cooperates with an inner surface of the injector cup 40 to define the high pressure fuel distribution chamber 51 within the injector cup 40.

The fuel rail structure 2 includes the log 10, which is an elongate hollow tube that provides a common rail or manifold. In the illustrated embodiment, the log 10 is cylindrical, but is not limited to having a cylindrical shape. The log 10 includes a log first end 11, a log second end 12 that is opposed to the log first end 11, and a longitudinal axis 16 that extends between the log first and second ends 11, 12. The log 10 is thick walled to accommodate high fuel pressures, and an inner surface 13 of the log defines the main fuel channel 15 through which fuel is supplied from a fuel tank or fuel pump (not shown). The centerline of the main fuel channel 15 coincides with the log longitudinal axis 16. The log material and dimensions are determined by the requirements of the specific application. For example, in some embodiments, the log 10 is a tube made of stainless steel, having a tube diameter in the order of 15 mm to 30 mm and having a wall thickness in the order of 1.5 to 4 mm. In some embodiments, the log 10 may include a boss 19 configured to receive a pressure sensor. One end of the log, for example the first end 11, may be shaped to provide an inlet connector 18, and the opposed end, for example the second end 12, is closed.

The fuel rail structure 2 includes the plurality of distribution arms 20 that protrude integrally from the log outer surface 14, and provide an integral connection between the log 10 and a respective injector cup 40. The distribution arms 20 are configured to provide high-pressure fuel to the respective fuel injectors 100 via the injector cups 40. The number of distribution arms 20 that protrude from the log 10 depends on the engine configuration. For example, when a four-cylinder engine is used, the log 10 is provided with four distribution arms 20 that are spaced apart long the longitudinal axis 16, and when a straight-six engine is used, the log 10 is provided with six distribution arms 20 that are spaced apart long the log longitudinal axis 16. Each distribution arm 20 includes a fuel passage 22 that communicates with the main fuel channel 15, as discussed in more detail below.

Each injector cup 40 is a cup-shaped structure that is disposed at the distal end of a corresponding distribution arm 20. Each injector cup 40 includes a cylindrical sidewall 41, and an inner surface 42 of the sidewall 41 defines a bore 47. Each injector cup 40 includes a proximal end 45 that protrudes from the corresponding distribution arm 20 and closes one end of the sidewall 41, and a distal end 46 that is opposite the proximal end 45. The bore 47 intersects the distal end 46. In particular, the bore 47 includes an open end 49 that coincides with the distal end 46, and a blind end 48 that is disposed between the bore open end 49 and the injector cup proximal end 45. In applications in which the fuel rail structure 2 is mounted above a cylinder block of the engine, the injector cups 40 open downward. A centerline 44 of the sidewall 41 extends through the injector cup proximal and distal ends 45, 46, and is perpendicular to the longitudinal axis 16 of the log 10.

When the inlet end 108 of a fuel injector 100 is disposed in the bore 47 of the injector cup 40, the seal 106 provided on the fuel injector inlet end 108 forms a fluid-impermeable seal with the sidewall inner surface 42 within a seal seating region 50 of the bore 47. The seal 106 segregates the interior space of the fuel injector cup 40 into two separate chambers 51, 52. The first chamber, referred to as the fuel distribution chamber 51, is defined between the seal 106, a first portion 41(1) of the sidewall 41 and the bore blind end 48. Fuel is provided to the fuel distribution chamber 51 via the main fuel channel 15 of the log 10 and the fuel passageway 22 of the respective distribution arm 20. In the illustrated embodiment, fuel is provided at high pressure to the fuel distribution chamber 51. The second chamber 52 is defined between the seal 106, a second portion 41(2) of the sidewall 41 and the bore open end 49. The second chamber 52 is open to the environment.

Figure 4:
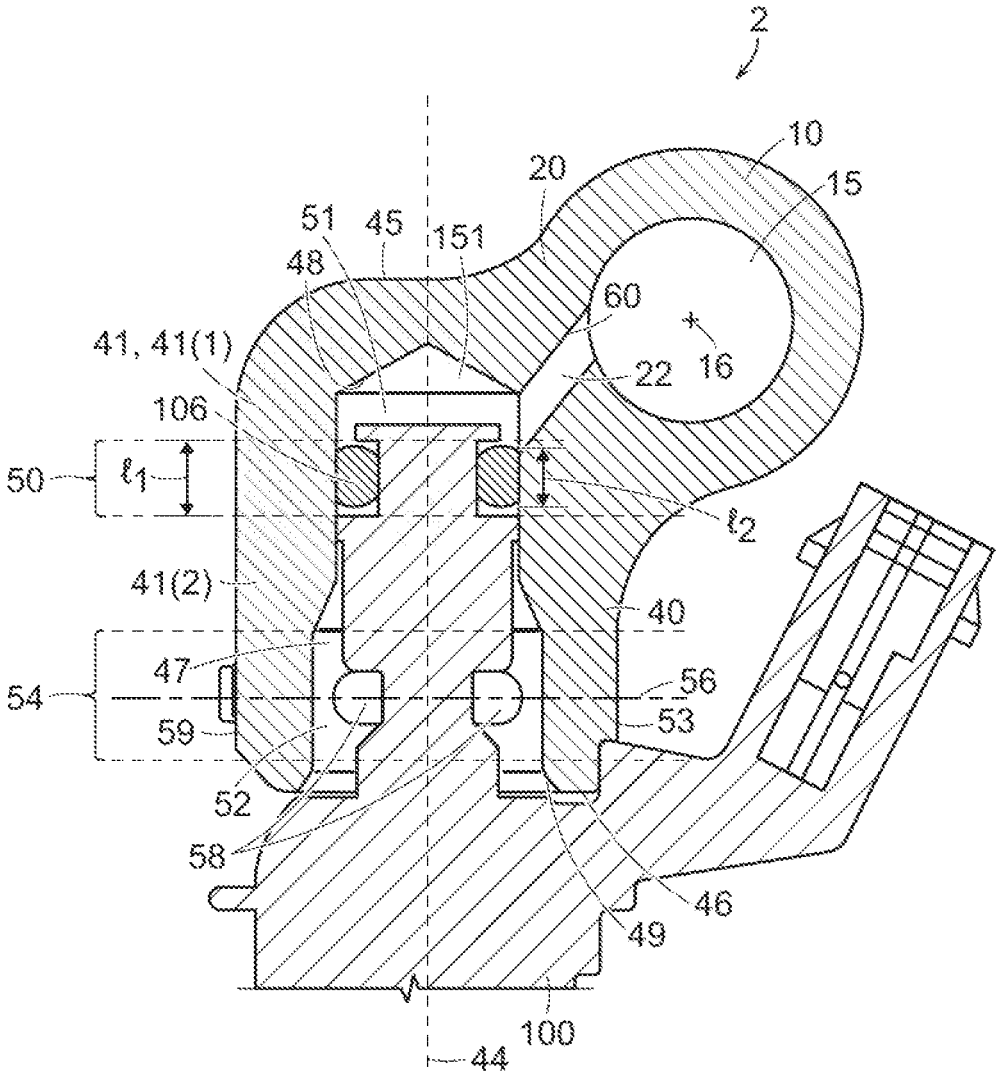

Referring to FIGS. 2 and 4, the seal seating region 50 is disposed between, and spaced apart from, the bore open end 49 and the bore blind end 48. The seal seating region 50 has a diameter that is dimensioned to receive, and form a fluid-impermeable seal with, the fuel injector seal 106. The seal seating region 50 of the injector cup 40 has a longitudinal dimension l1 (e.g., a dimension in a direction that is parallel to the sidewall centerline 44) that is greater than the corresponding dimension l2 of the fuel injector seal 106. The longitudinal dimension l1 of the seal seating region 50 is set to a so as to accommodate longitudinal movement of the fuel injector 100 within the injector cup 40 during operation of the fuel rail structure 2. The longitudinal motion may be a result of vehicle vibration, engine vibration, pressure variation within the fuel distribution chamber 51, etcetera. In some embodiments, for example, the longitudinal dimension l1 of the seal seating region 50 may be in a range of 120 percent to 300 percent of the longitudinal dimension of the seal 106.

The bore 47 of each injector cup 40 includes an injector retaining region 54 that is disposed between the seal seating region 50 and the distal end 46. The injector retaining region 54 has a greater diameter than the seal seating region 50, and includes the bore open end 49. A pair of through holes 55 are provided in the sidewall 41 within the injector retaining region 54. The through holes 55 are parallel to each other and reside in a plane 56 that is perpendicular to the sidewall centerline 44. The through holes 55 are spaced apart from each other, a through hole 55 is disposed on each side of the sidewall centerline 44. Each through hole 55 is shaped and dimensioned to receive a retaining pin 58 in a press or spring fit. The through holes 55 are arranged so that when a fuel injector 100 is disposed in the bore 47 and a retaining pin 58 is disposed in each of the through holes 55, the retaining pins 58 extend through the bore 47 on each of opposed sides of the fuel injector 100. In addition, the retaining pins 58 are received in a reduced diameter portion 114 of the fuel injector housing 102, whereby the retaining pins 58 cooperate with the reduced-diameter portion 114 of the fuel injector housing 102 to retain the fuel injector 100 in the bore 47. In other embodiments, the fuel injector 100 may be retained rigidly "unsuspended fashion" with an external spring or clip, whereby the retaining pins 58 and corresponding through holes 55 may be omitted.

Figure 5:
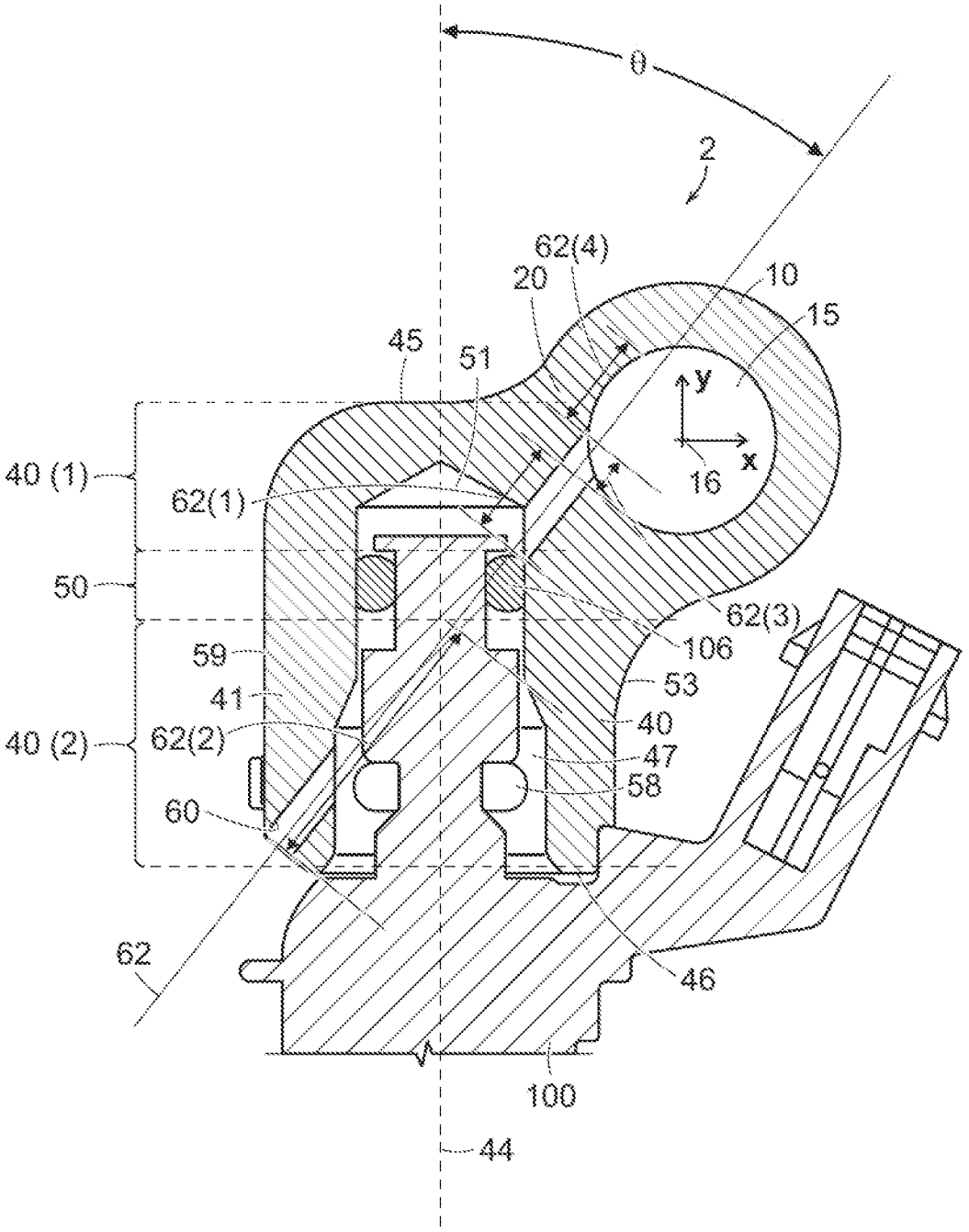

Referring to FIG. 5, as previously mentioned, each distribution arm 20 includes the fuel passage 22 that provides fluid communication between the main fuel channel 15 of the log 10 and the fuel distribution chamber 51 of the bore 47 of the injector cup 40. Each fuel passage 22 extends linearly, and coincides with a reference line 62. The reference line 62 includes a first line portion 62(1) that resides in a first portion of the injector cup 40(1), and a second line portion 62(2) that resides in a second portion of the injector cup 40(2). In addition, the reference line 62 includes a third line portion 62(3) that provides a centerline of the fuel passage 22, and a fourth line portion 62(4) that resides in the main fuel channel 15.

The first portion of the injector cup 40(1) is disposed between the seal seating region 50 and the injector cup proximal end 45. The first line portion 62(1) resides in the first portion of the injector cup 40(1) and extends through the first portion 41(1) of the sidewall 41 on one side of the injector cup 40. In the illustrated embodiment, the one side of the injector cup 40 is on a side of the injector cup 40 that faces the log 10, e.g., the injector cup 40 is on the injector cup inward side 53.

The second portion of the injector cup 40(2) is disposed between the seal seating region 50 and the injector cup distal end 46. The second line portion 62(2) resides in the second portion of the injector cup 40(2) and extends through the second portion 41(2) of the sidewall 41 on a side of the injector cup 40 that is opposed to the injector cup inward side 53. In the illustrated embodiment, the opposed side is on a side of the injector cup 40 that faces away from the log 10, e.g., the injector cup 40 is on the injector cup outward side 59, where the injector cup outward side 59.

Thus, the first line portion 62(1) intersects the sidewall 41 at a location between the seal seating region 50 and the bore blind end 48, and the second line portion 62(2) intersects the sidewall 41 at a location between the seal seating region 50 and the bore open end 49.

As discussed below, the fuel passage 22 is formed in the monolithic fuel rail structure 2 by forming a hole 60 in the fuel rail structure 2. The hole 60 is centered on the line 62, and coincides with the first, second and third line portions 62(1), 62(2), 62(3). In particular, the hole 60 passes through the second portion 41(2) of the sidewall 41 on the injector cup outward side 59. The hole 60 is interrupted as the line 62 passes through the bore 47, and the hole 60 continues through the first portion 41(1) of the sidewall 41 on the injector cup inward side 53. In order to provide communication between the fuel distribution chamber 51 and the main fuel channel 15, the hole 60 passes through the injector cup inward side 53 within the injector cup first portion 40(1), e.g., at a location between the seal seating region 50 and the injector cup proximal end 45. In addition, the hole 60 passes through the length of the distribution arm 20 that connects the injector cup 40 to the log 10, and through the wall of the log 10 so that the fuel passage 22 communicates with the main fuel channel 15.

In order to maintain the sealed integrity of the fuel distribution chamber 51, the hole 60 can only pass through the injector cup outward side 59 within the injector cup second portion 40(2), e.g., at a location between the seal seating region 50 and the injector cup distal end 46, which corresponds to the second chamber 52 that is open to the environment. Thus, the line 62 may be at an angle θ relative to the sidewall centerline 44. In some embodiments, the angle 9 may be zero, whereby the line is parallel to the sidewall centerline 44, and the injector cup 40 substantially underlies the log 10. For an angle θ of zero, the injector cup centerline 44 may be offset in an X direction relative to the log longitudinal axis 16 a distance corresponding to a diameter of the bore 47. As used herein, references to the X direction and a Y direction are made with respect to orthogonal reference axes X and Y that originate on the log longitudinal axis 16. The X and Y axes are perpendicular to the log centerline, and the Y axis is parallel to the injector cup centerline 44.

The maximum angle θ is the angle at which the hole 60 passes through the injector cup outward side 59 immediately below the seal seating region 50 and also passes through the injector cup inward side 53 immediately above the seal seating region 50. Thus, the maximum angle θ is limited by the geometry of the injector cup 40, including the bore diameter and the longitudinal dimension of the seal seating region 50. In some embodiments, for example, the angle θ may be in a range of 0 degrees to 70 degrees. In other embodiments, the angle θ may be in a range of 0 degrees to 45 degrees. When the angle θ is maximized, the injector cup 40 may be positioned along the injector cup sidewall 41. In this configuration, the injector cup 40 may be closer to the log longitudinal axis 16 in the y direction and further from the centerline in the X direction relative to the injector cup 40 configuration when the angle θ is zero.

The fuel passage 22 is formed in the fuel rail structure 22 that, in turn, is formed of a single piece with integral injector cups 40 by passing the hole 60 at an angle through opposed sides 53, 59 (or 45, 46) of the injector cup 40. By this configuration, it becomes possible to provide the injector cup 40 with an X and Y offset from the center line 16 of log 10. For example, with respect to the orientation of the fuel rail structure illustrated in FIGS. 2-5, which is not intended to be limiting, the injector cup 40 may be disposed offset from the log longitudinal axis 16 to one side of, and below, the log longitudinal axis 16. Since the injector cup 40 can be provided at an X and Y offset relative to the long centerline 16, the engine designers have more flexibility to package the fuel rail assembly to the engine.

In addition, since the fuel rail structure 2 can be formed as a single, monolithic structure, the fuel rail structure 2 can directly replace some conventional fuel rail devices that are multi-component brazed assemblies. In other words, the monolithic fuel rail structure 2 is "backward compatible", whereby a vehicle engine can be upgraded, increasing fuel pressure and reducing the number of parts, with limited redesign and testing of the cylinder head, fuel injectors, pressure sensors, conning tubes and electrical harnesses, etc. saving the builder time and money while reducing risk of untested components. The monolithic fuel rail structure 2 allows reuse of equipment and process measures. Moreover, by providing a monolithic fuel rail structure 2, multiple components and their fastening processes (tack welding and brazing) can be eliminated, reducing the number and locations of possible failures and quality control methods.

Figure 6:
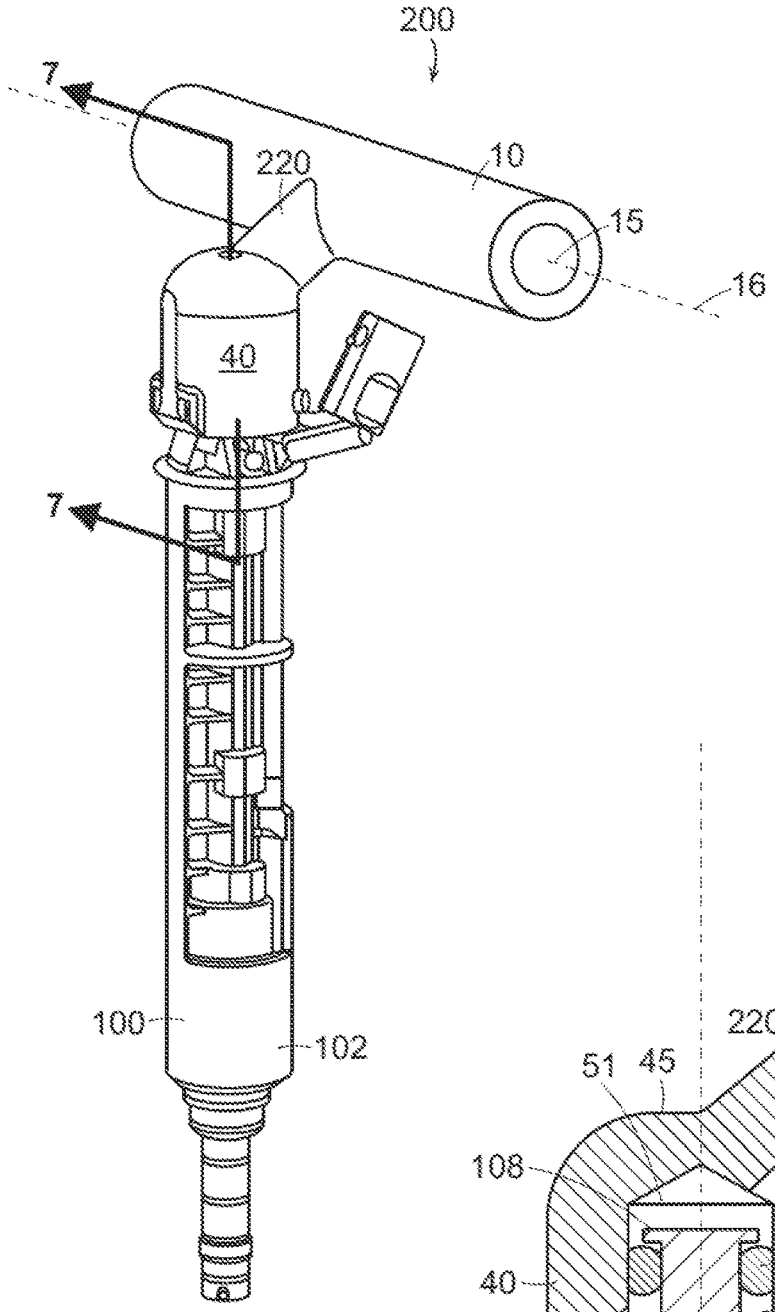
FIG. 6 is a perspective view of a portion of an alternative embodiment monolithic fuel rail structure, shown with a fuel injector disposed in the injector cup.
Figure 7:
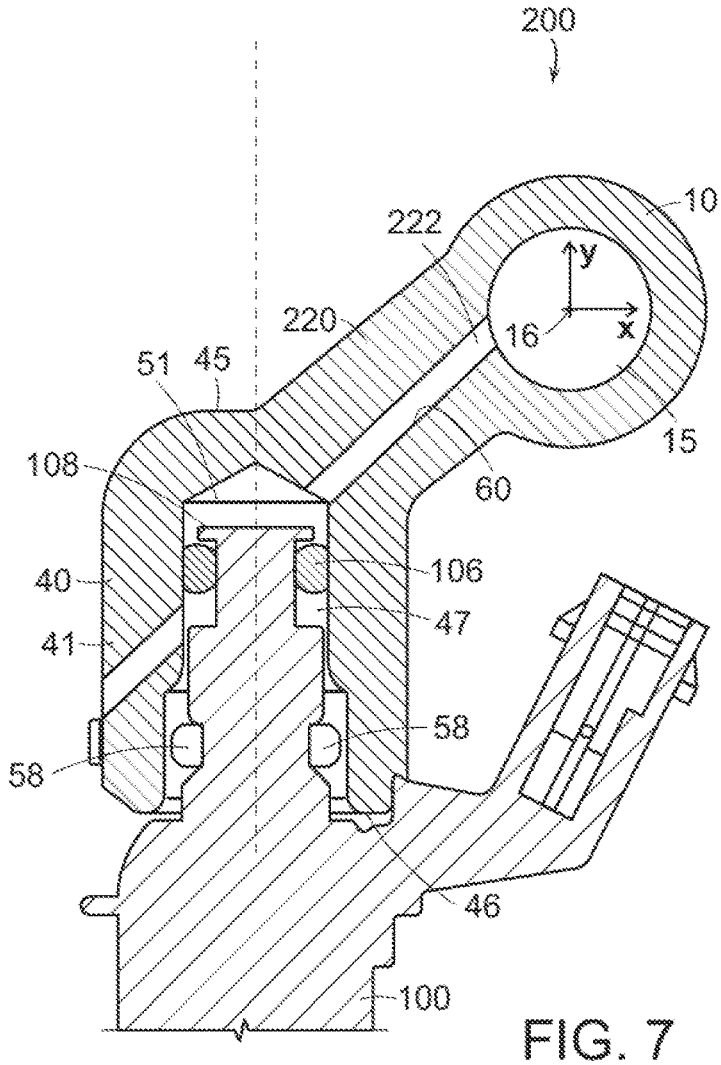
FIG. 7 is a cross sectional view of a portion of FIG. 5 as seen along line 7-7 of FIG. 6.

Referring to FIGS. 6 and 7, an alternative embodiment monolithic fuel rail structure 200 is similar to the fuel rail structure 2 described above with respect to FIGS. 1-5, and common elements are referred to with common reference numbers. The monolithic fuel rail structure 200 differs from the previous embodiment in that it includes a relatively longer distribution arm 220 and fuel passage 222. For example, in the illustrated embodiment, the distribution arm 220 has sufficient length that the injector cup 40 is spaced apart from the log 10. Advantageously, since the distribution arm 200 is relatively long, the X offset of the injector cup 40 is relatively greater, as compared to the earlier embodiment. Since the injector cup 40 can be provided at a relatively greater X offset relative to the long centerline 16, the engine designers have even more flexibility to package the fuel rail assembly to the engine.

Figure 8:
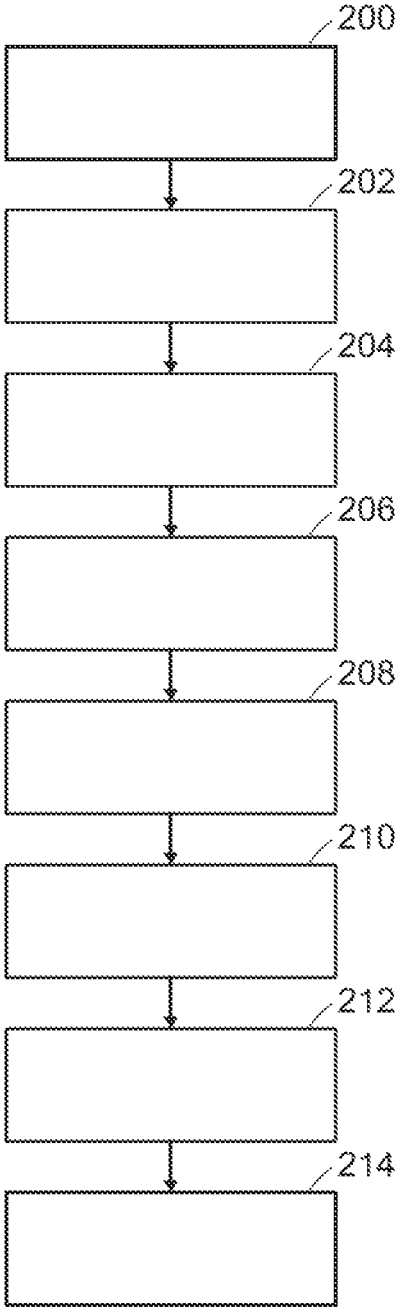
FIG. 8 is a flow chart that represents a method of manufacturing the monolithic fuel rail structure.

Referring to FIG. 8, the fuel rail structure 2, 200, which includes the log 10, the distribution arms 20, 200 and the injector cups 40, is manufactured as monolithic structure in a forging process. As used herein, the term "forging process" refers to a forming process in which a billet of metal is heated up until it is malleable but not molten, and is mechanically forced into the desired shape. This may be achieved manually, for example via manual hammering, or by machine, for example via power hammering, high pressure stamping or pressing. In the illustrated embodiment, the fuel rail structure 2 is manufactured using the following manufacturing steps.

In an initial step (step 200), a metal billet is provided. The billet is a mass of the raw material that is to be used to form the fuel rail structure. In the illustrated embodiment, the material is stainless steel, but other possible materials include, but are not limited to, low carbon, high strength steel and high strength aluminum.

The metal billet is then heated (step 202) to a predetermined temperature that is sufficient to facilitate forging of the billet, and that is less than the melting temperature of the metal. In an example in which the material used to form the billet is stainless steel, the predetermined temperature may be in a range of 600 degrees Celsius to 1000 degrees Celsius, as needed by the process.

Following the heating step, the heated metal billet is subjected to a forging step (step 204) to provide a monolithic fuel rail structure. The resulting preliminary fuel rail structure has an irregular and complex shape, and is a solid body (e.g., the preliminary fuel rail structure has no internal vacancies). The preliminary fuel rail structure includes a solid log portion, and solid protrusions corresponding to the distribution arm portions and injector cup portions. It may be necessary to subject the billet to multiple alternating heating and forging steps before the preliminary fuel rails structure has the desired shape. If needed, excess material may be trimmed from the preliminary fuel rails structure.

The preliminary fuel rail structure is then machined to provide the required internal cavities and or passageways. For example, a first machining step (step 206) may include using a twist drill to form a first hole in the preliminary fuel rail structure. In particular, the first hole is made in the log portion, and corresponds to the main fuel channel 15. The first hole is a straight line hole that extends along the log longitudinal axis 16. In some embodiments, the first hole is a blind hole that opens at a fuel inlet in the log first end 11. In other embodiments, the first hole is a through hole that opens at both the log first and second ends 11, 12. In the case of a through hole, the log first end 11 may be configured to provide a fuel inlet, and the log second end 12 may be plugged. Although a twist drill may be used, the first machining step 206 is not limited to being performed with a twist drill. For example, in some embodiments, the first hole may be formed using an EDM process or other appropriate machining process.

A second machining step (step 208) may include using a twist drill to form a second hole in the preliminary fuel rail structure. In particular, the second hole is made in the injector cup portion, and corresponds to the injector cup bore 47. The second hole is a straight line, blind hole that opens at the injector cup distal end 46. Since the bore 47 includes the seal seating region 50 that may have a different diameter than the injector retaining region 54, the second machining step 208 may include multiple sub-steps in which machining tools having different diameters are employed. Although a twist drill may be used, the second machining step 208 is not limited to being performed with a twist drill. For example, in some embodiments, the second hole may be formed using an EDM process or other appropriate machining process.

A third machining step (step 210) may include using an EDM process to form a third hole in the preliminary fuel rail structure. In particular, the third hole will form the fuel passage 22 in the distribution arm portion. The third hole is a straight line through hole that passes through the injector cup portion and the distribution arm portion, and connects the bore 47 with the main fuel channel 15 of the log 10. In particular, the third hole enters the log preliminary structure along the injector cup outward side at a location corresponding to the injector cup second portion 40(2). Thus, the entry location of the third hole is disposed on a side of the injector cup portion that faces away from the log portion. The third hole extends linearly along the line 62, and passes through the injector cup inward side 53 at a location corresponding to the injector cup first portion 40(2). The line 62 is appropriately angled to avoid the seal seating region 50 and to extend through the distribution arm portion and intersect the main fuel channel 15.

A rotating EDM process that employs a rigid, linear (e.g., straight) electrode is used to create the third hole, which advantageously provides a precisely and uniformly dimensioned hole that is free of cutting debris. Although the third hole may be formed using other machining processes such as twist drilling or laser cutting, such processes may, in some cases, may disadvantageously leave debris in the hole or create burrs within the hole. By this step, the fuel passage 22 is formed, which extends along the straight line 62. In some embodiments, the fuel passage 22 is at a non-zero angle relative to the centerline 44 of the injection cup 40, and the entry hole of the third machining step 210 is disposed in the sidewall 41 of the injector cup 40.

A fourth machining step (step 212) may include using a twist drill to form fourth and fifth holes in the preliminary fuel rail structure. In particular, the fourth and fifth holes are made in the injector cup portion, and corresponds to the through holes 55 that received the injector retaining pins 58. The fourth and fifth holes may be straight through holes.

The first, second, third and fourth machining steps 206, 208, 210, 212 may be performed in any order.

Following the first, second, third and fourth machining steps 206, 208, 210, 212, the machined preliminary fuel rail structure is subjected to a chemical deburring step (step 214). For example, the machined preliminary fuel rail structure may be dipped into a plating bath that removes burrs and sharp edges, and results in the finished fuel rail structure 2, 200.

Although the fuel rail structure 2 is described herein as being a monolithic structure manufactured of a piece in a forging process, the fuel rail structure 2 is not limited to being manufactured via forging process. For example, the fuel rail structure may be manufactured as a monolithic structure via other processes, such as, but not limited to, casting or injection molding.

Although the illustrated embodiments include a fuel rail structure that supplies high pressure fuel directly to the cylinders of an engine via fuel injectors, the fuel rail structure is not limited to be used in a high pressure, direct injection fuel supply system. For example, in other embodiments, the fuel rail structure may supply fuel at relatively low pressure. In still other embodiments, the fuel rail structure may supply fuel to the cylinders indirectly, for example via an intake port.

Selective illustrative embodiments of the monolithic fuel rail structure and its method of manufacture are described above in some detail. It should be understood that only structures considered necessary for clarifying the fuel rail structure have been described herein. Other conventional structures, and those of ancillary and auxiliary components of the hydraulic circuit including the reclamation device, are assumed to be known and understood by those skilled in the art. Moreover, while working examples of the monolithic fuel rail structure and its method of manufacture have been described above, the monolithic fuel rail structure and its method of manufacture are not limited to the working examples described above, but various design alterations may be carried out without departing from the monolithic fuel rail structure and its method of manufacture as set forth in the claims.

We claim:

1. A monolithic fuel rail structure that is configured to receive and support a fuel injector, the fuel injector having an injector housing, a fuel inlet end, a fuel outlet end opposed to the fuel inlet end, and a seal disposed on an outer surface of the injector housing, the monolithic fuel rail structure comprising:

a log;

an injector cup that protrudes integrally from an outer surface of the log; and a fuel passage, wherein the log includes:

a log first end;

a log second end that is opposed to the log first end; and a log inner surface that defines a main fuel channel that is concentric with a longitudinal axis of the log, the longitudinal axis of the log extending between the log first end and the log second end, the injector cup includes:

a sidewall, an inner surface of the sidewall defining a bore;

a proximal end that closes one end of the sidewall; and a distal end that is opposite the proximal end, the distal end being open, a centerline of the sidewall extending through the proximal end and the distal end, and wherein the bore includes an open end that coincides with the distal end, the bore includes a blind end disposed between open end and the injector cup proximal end, the fuel passage provides fluid communication between the bore and the main fuel channel, the fuel passage corresponding to a portion of a hole, and the hole is linear, has a first end that intersects with the main fuel channel, and extends through the injector cup on each of opposed sides of the injector cup.

2. The monolithic fuel rail structure of claim 1, wherein the hole passes through the injector cup sidewall so as to extend through a log facing side of the sidewall and extend through a side of the sidewall that is opposed to the log-facing side of the sidewall.

3. The monolithic fuel rail structure of claim 1, wherein the sidewall inner surface includes a seal seating region that receives the seal when a fuel injector is disposed in the injector cup, the seal seating region being disposed between the open end and the blind end, the hole is coincident with a straight line that passes through the sidewall, and the straight line includes a) a first line portion that resides in a first portion of the injector cup, the first portion of the injector cup being disposed between the seal seating region and the proximal end, and b) a second line portion that resides in a second portion of the injector cup, the second portion of the injector cup being disposed between the seal seating region and the distal end.

4. The monolithic fuel rail structure of claim 3, wherein the seal seating region has a dimension in a direction parallel to the centerline of the sidewall that is greater than a dimension of the seal in a direction parallel to the centerline of the sidewall so as to accommodate movement of the fuel injector within the injector cup during operation of the fuel rail structure.

5. The monolithic fuel rail structure of claim 3, wherein the hole extends through a first portion of the sidewall, and the first portion of injector cup includes the first portion of the sidewall.

6. The monolithic fuel rail structure of claim 3, wherein the hole extends through a second portion of the sidewall, and the second portion of injector cup includes the second portion of the sidewall.

7. The monolithic fuel rail structure of claim 3, wherein the first line portion intersects the sidewall at a location between the seal seating region and the blind end, and the second line portion intersects the sidewall at a location between the seal seating region and the open end.

8. The monolithic fuel rail structure of claim 1, wherein the hole is coincident with a straight line that passes through the sidewall, the straight line is at an angle θ relative to a Y axis, the Y axis intersects, and is perpendicular to, the longitudinal axis of the log, the Y axis is parallel to the centerline of the sidewall, and the angle θ is in a range of 0 degrees to forty five degrees.

9. The monolithic fuel rail structure of claim 1, wherein the injector cup is connected to the outer surface of the log via a distribution arm having an arm first end that is integral with the outer surface of the log and an arm second end that is integral with the injector cup, and the fuel passage passes through the distribution arm.

10. The monolithic fuel rail structure of claim 9, wherein the distribution arm has sufficient length that the injector cup is spaced apart from the log.

11. The monolithic fuel rail structure of claim 1, wherein the seal seating region has a dimension in a direction parallel to the centerline of the sidewall that is in a range of 150 percent to 300 percent greater than a corresponding dimension of the seal.

12. A fuel rail assembly that comprises a monolithic fuel rail structure and a fuel injector supported on the fuel rail structure, wherein the fuel injector comprises:

an injector housing;

a fuel inlet end;

a fuel outlet end opposed to the fuel inlet end; and a seal disposed on an outer surface of the injector housing, the monolithic fuel rail structure comprises:

a log;

an injector cup that protrudes integrally from an outer surface of the log; and a fuel passage, the log including:

a log first end;

a log second end that is opposed to the log first end; and a log inner surface that defines a main fuel channel that is concentric with a longitudinal axis of the log, the longitudinal axis of the log extending between the log first end and the log second end, and the injector cup including:

a sidewall, an inner surface of the sidewall defining a bore;

a proximal end that closes one end of the sidewall; and a distal end that is opposite the proximal end, the distal end being open, a centerline of the sidewall extending through the proximal end and the distal end, and wherein the bore includes an open end that coincides with the distal end, the bore includes a blind end disposed between the open end and the injector cup proximal end, the fuel passage provides fluid communication between the bore and the main fuel channel, the fuel passage corresponding to a portion of a hole, and the hole is linear, has a first end that intersects with the main fuel channel, and extends through the injector cup on each of opposed sides of the injector cup.

13. A monolithic fuel rail structure that is configured to receive and support a fuel injector relative to a cylinder of an engine, the monolithic fuel rail structure comprising:

a log having an inner surface that defines a main fuel channel;

an injector cup that protrudes integrally from an outer surface of the log, an inner surface of the injector cup define a bore that opens at one end of the injector cup; and a fuel passage that provides fluid communication between the bore and the main fuel channel, wherein the fuel passage corresponds to a portion of a hole, and the hole is linear, has a first end that intersects with the main fuel channel, and extends through the injector cup on each of opposed sides of the injector cup.

* * * * *